US006360459B1

(12) United States Patent
Brookhart et al.

(10) Patent No.: US 6,360,459 B1
(45) Date of Patent: Mar. 26, 2002

(54) TILTABLE BUCKET ASSEMBLY

(75) Inventors: Roy V. Brookhart; Scott E. Keele, both of Cary; J. Brian Normann, Holly Springs; Kevin J. Romanchok, Holly Springs; Philip H. Warren, Jr., Holly Springs, all of NC (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/570,860

(22) Filed: May 12, 2000

(51) Int. Cl.[7] ..... E02F 3/76

(52) U.S. Cl. ..... 37/442; 37/444; 37/231; 37/234; 172/825; 414/697; 414/723

(58) Field of Search ..... 414/724, 725, 414/726, 727, 723, 722, 697, 607; 298/17.6; 37/468, 442, 444, 266, 214, 231, 234; 172/811, 815, 824, 825

(56) References Cited

U.S. PATENT DOCUMENTS

| | | | | |
|---|---|---|---|---|
| 3,072,391 | A | 1/1963 | McDarrah | |
| 3,444,936 | A | 5/1969 | Page et al. | 172/795 |
| 3,512,283 | A | 5/1970 | Moody et al. | 37/117.5 |
| 3,534,817 | A | 10/1970 | Garis et al. | 172/4 |
| 3,539,022 | A | 11/1970 | Berg | 172/805 |
| 3,606,467 | A | 9/1971 | Christensen et al. | 299/39 |
| 3,631,931 | A | 1/1972 | Frisbee | 172/807 |
| 3,645,340 | A | 2/1972 | Frisbee | 172/804 |
| 3,698,490 | A | 10/1972 | King | 172/803 |
| 3,976,146 | A | 8/1976 | Desourdy | 172/788 |
| 4,281,721 | A | 8/1981 | Beales | 172/821 |
| 4,454,665 | A | 6/1984 | Mannbro | 37/103 |
| 4,512,090 | A | 4/1985 | Billings | 37/117.5 |
| 4,540,330 | A | 9/1985 | Taylor | 414/641 |
| 4,664,203 | A | 5/1987 | Williams | 172/826 |
| 4,824,319 | A | 4/1989 | Arnold | 414/723 |
| 4,893,683 | A | 1/1990 | Horsch et al. | 172/821 |
| 5,114,299 | A | 5/1992 | Roche et al. | 414/722 |
| 5,141,288 | A | 8/1992 | Smith | 298/17.6 |
| 5,281,076 | A | 1/1994 | Lehman | 414/607 |
| 5,403,144 | A | 4/1995 | Staben, Jr. | 414/697 |
| 5,447,204 | A | 9/1995 | Asal et al. | 172/821 |
| 5,562,398 | A | 10/1996 | Knutson | 414/732 |
| 5,669,750 | A | 9/1997 | Vieselmeyer | 414/722 |
| 5,938,399 | A | 8/1999 | Knutson | 414/722 |

*Primary Examiner*—Christopher J. Novosad
(74) *Attorney, Agent, or Firm*—Diana L. Charlton

(57) ABSTRACT

A tiltable bucket assembly includes a bucket and an interface member. The bucket has a front loading portion, a rear connecting portion with a front surface adjacent the front loading portion and a rear surface opposite therefrom, and a pair of spaced guide members connected to the rear surface. The bucket defines a substantially enclosed chamber that extends from the front surface and terminates within the front loading portion. The interface member is rotatably mounted with the bucket. The interface member has opposed side portions supported within the guide members. A hydraulic cylinder is located within the chamber and has a rod end portion connected to the bucket and a head end portion connected to the interface member. The hydraulic cylinder is adapted to provide rotational movement of the bucket about the interface member upon actuation.

17 Claims, 8 Drawing Sheets

TILTABLE BUCKET ASSEMBLY

This invention relates generally to a tiltable bucket assembly connected to a work machine, such as a skid steer loader. More particularly, the invention relates to the ability to rotate a bucket through the actuation of a hydraulic cylinder located within a substantially enclosed chamber defined in the bucket and to achieve the rotation without additional or separate components.

BACKGROUND ART

In addition to lifting and lowering an attachment on a work machine, it is often desirable to control the tilt of the attachment in relation to the work machine so that material therein may be dumped to either side of the work machine, as needed, or the side corner of the attachment may be used as a cutting edge or scraper. Also, the ability to tilt the attachment may be used to level a load when the work machine is on uneven terrain.

It is well-known to utilize a mounting assembly for supporting a scraping tool, such as a bulldozer blade, forward of a vehicle (e.g. a bulldozer) that enables independent angling and tilting of the scraping tool. As seen in U.S. Pat. No. 4,281,721 issued to John H. Beales on Aug. 4, 1981, a mounting assembly, such as that described, includes a U-shaped mainframe, a swingframe, means for pivotally connecting the scraping tool to the swingframe, tilt actuator means interconnecting the mainframe and the scraping tool in relation to the swingframe about a tilting axis of rotation, and angle actuator means interconnecting the mainframe and the swingframe for rotating the swingframe and scraping tool in relation to the mainframe about an angling axis of rotation. In this patent, it is advantageous to have both the tilt and angling functions independent from one another with simple connections for lesser stress on the scraping tool. The actuation of a hydraulic motor is used to achieve the tilt function. However, the hydraulic motor is connected between the swingframe and the scraping tool and is exposed to environmental hazards, such as dirt and debris.

It is also well-known to utilize a tiltable attachment for a work machine, such as a skid steer loader. As seen in U.S. Pat. No. 5,562,398 issued to Kenneth Knutson on Oct. 8, 1996, a tiltable attachment is secured to loader arms of a skid steer loader and receives and fastens a utility attachment to the skid steer loader. The tiltable attachment includes a mounting base member and a pivotal attachment member. The members are rotated by a power cylinder. The pivotal attachment member has a demountable cover plate. The pivotal attachment member will receive commonly known utility attachments. The tiltable attachment maintains the ability of the skid steer loader to move the utility attachments in the vertical and horizontal planes while further providing the ability to rotate the utility attachment around the longitudinal axis of the skid steer loader machine. This patent allows for rotation of any utility attachment, such as a bucket, forks, blade, and the like, without any structural changes in conventional utility attachments. However, the use of the tiltable attachment between the utility attachment and the work machine increases the distance between the utility attachment and the work machine. The increased distance therebetween decreases breakout forces and promotes instability and lower performance. Additionally, the power cylinder is located within the pivotal attachment member adjacent a large orifice at a position near the surface of the ground. Such positioning of the power cylinder increases the risk that dirt and debris will enter the pivotal attachment member thus damaging the power cylinder.

The present invention is directed to overcoming the problems as set forth above.

DISCLOSURE OF THE INVENTION

In one aspect of the present invention, a tiltable bucket assembly is disclosed that comprises a bucket with a front loading portion, a rear connecting portion with a front surface adjacent the front loading portion and a rear surface opposite therefrom, and a pair of spaced guide members connected to the rear surface of the rear connecting portion. The bucket defines a substantially enclosed chamber that extends from the front surface of the rear connecting portion and terminates within the front loading portion. An interface member is rotatably mounted with the bucket. The interface member has opposed side portions supported within the guide members. An actuator is located within the chamber and has a first end portion connected to the bucket and a second end portion connected to the interface member. The actuator is adapted to provide rotational movement of the bucket about the interface member.

In another aspect of the invention, a tiltable bucket assembly is disclosed that comprises a bucket with a front loading portion with upper and lower regions, a rear connecting portion with a front surface adjacent the front loading portion and a rear surface opposite therefrom, a pair of spaced guide members connected to the rear surface of the rear connecting portion with each of the pair of guide members having a pair of curved plates and a shim plate separating the pair of curved plates to define a spaced opening therebetween, and a hub portion that extends from the rear surface of the rear connecting portion and has a longitudinal axis. The bucket defines a substantially enclosed chamber that extends from the front surface of the rear connecting portion and terminates within the upper region of the front loading portion. An interface member is rotatably mounted with the hub portion of the bucket. The interface member has opposed side portions with curved outer peripheries supported within the spaced openings in the guide members. A hydraulic cylinder is located within the chamber and has a first end portion connected to the bucket and a second end portion connected to the interface member. The hydraulic cylinder is adapted to provide rotational movement of the bucket about the longitudinal axis.

In yet another aspect of the present invention, a work machine is disclosed that has a frame that supports a plurality of wheels. The work machine comprises a connecting member with a first end portion connectable with the frame and a second end portion. The connecting member is adapted for movement in a vertical plane. A bucket assembly includes an interface member releasably connected at the second end portion of the connecting member. The interface member has opposed side portions. A bucket is rotatably mounted with the interface member and has a front loading portion, a rear connecting portion with a front surface adjacent the front loading portion and a rear surface opposite therefrom, and a pair of spaced guide members connected to the rear surface of the rear connecting portion for supporting the opposed side portions of the interface member. The bucket defines a substantially enclosed chamber that extends from the front surface of the rear connecting portion and terminates within the front loading portion. An actuator is located within the chamber and has a first end portion connected to the bucket and a second end portion connected to the interface member. The actuator is adapted to provide rotational movement of the bucket about the interface member upon actuation thereof.

The present invention tiltable bucket assembly allows for rotation of a bucket about an interface member through the actuation of a hydraulic cylinder located within a substantially enclosed chamber defined by the bucket. The actuator has a first end portion connected to the bucket and a second end portion connected to the interface member. The ability to locate the hydraulic cylinder within the bucket produces a compact design that increases the break out force as compared to other rotatable bucket designs with increased stability and improved performance while protecting the hydraulic cylinder from dirt and debris.

BEST MODE FOR CARRYING OUT THE INVENTION

Figure 1:
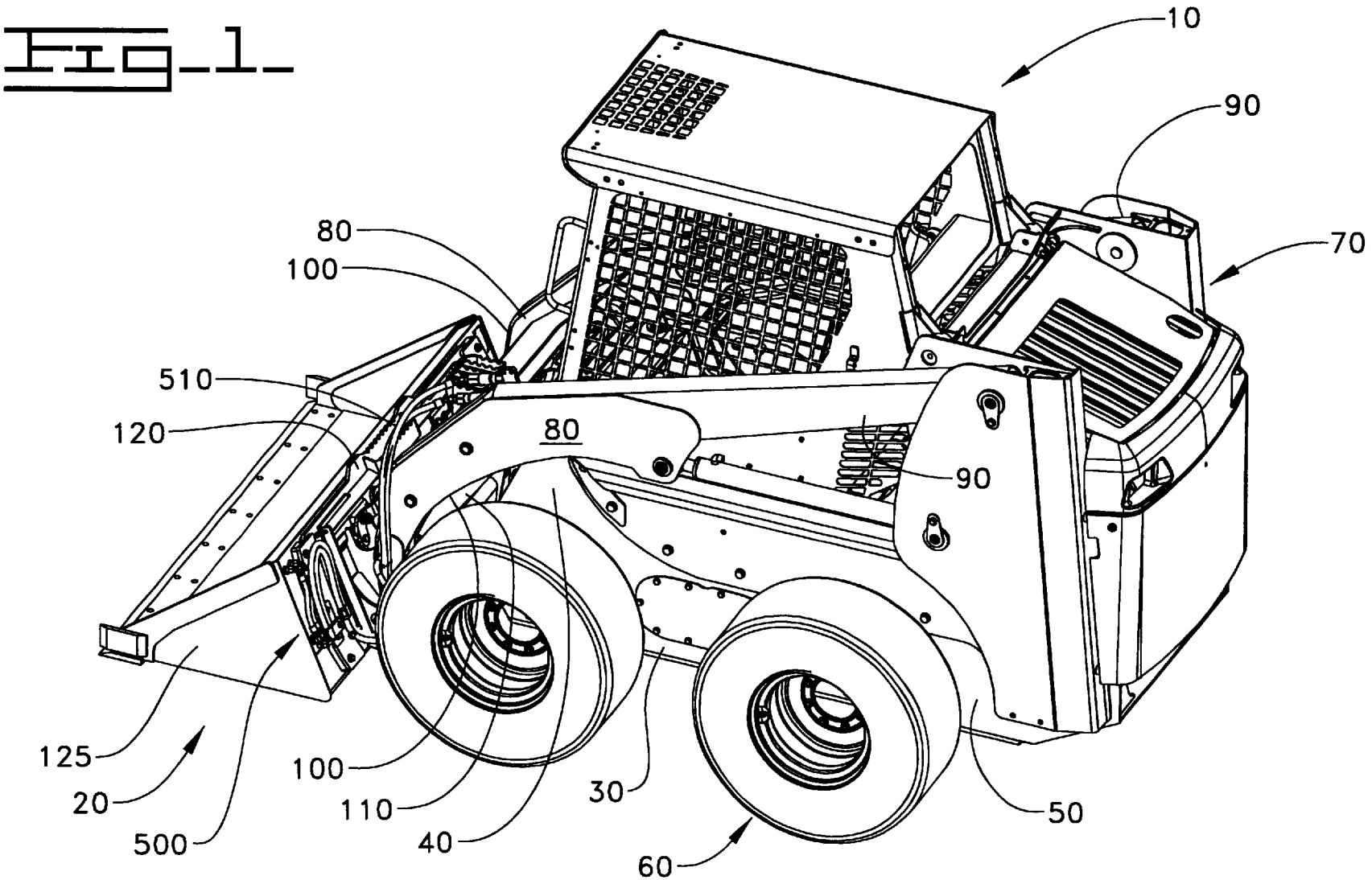
FIG. 1 is a perspective view of a skid steer loader machine embodying the present invention tiltable bucket assembly thereon.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring to FIG. 1, a work machine 10, such as a skid steer loader, is shown incorporating the present invention tiltable bucket assembly 20. It should be understood that any other type of work machine utilizing the tiltable bucket assembly 20 may also be considered within the scope of the present invention. The work machine 10 includes a frame 30 with front and rear end portions 40,50 supported by a plurality of wheels 60. A lift arm assembly 70 includes a pair of spaced loader arms 80 with a first end portion 90 conventionally mounted to the rear end portion 40 of the frame 30 to provide movement of the lift arm assembly 70 in a vertical plane. A second end portion 100 of the loader arms 80 supports the tiltable bucket assembly 20 in any well known manner, such as through a coupler mechanism 110. It should be understood that the tiltable bucket assembly 20 could be connected to the loader arms 80 without the use of a separate coupler mechanism 110. The work machine 10 includes a conventional hydraulic system (not shown) to provide a source of pressurized hydraulic fluid for use throughout the work machine 10.

The tiltable bucket assembly 20 includes an interface member 120 releasably attached to the coupler mechanism 110 in any suitable manner and a bucket 125 rotatably mounted with the interface member 120.

Referring to FIGS. 2–7, various details of the tiltable bucket assembly 20 can be seen in more detail. Referring more specifically to FIGS. 4*a* & 4*b*, the interface member 120 has opposed side portions 130 with curved outer peripheries 140 and front and rear surfaces 150,160, respectively. An upper portion 170 of the interface member 120 includes a serrated area 180. A step member 190 includes a serrated upper surface 200 connected at the upper portion 170 of the interface member 120 and spaced from the serrated area 180 in such a manner to define a spaced, uneven step 210 for an operator's foot (not shown) when entering or exiting the work machine 10. The interface member 120 defines a plurality of openings 220 extending therethrough, seen best in FIG. 6.

Figure 2:
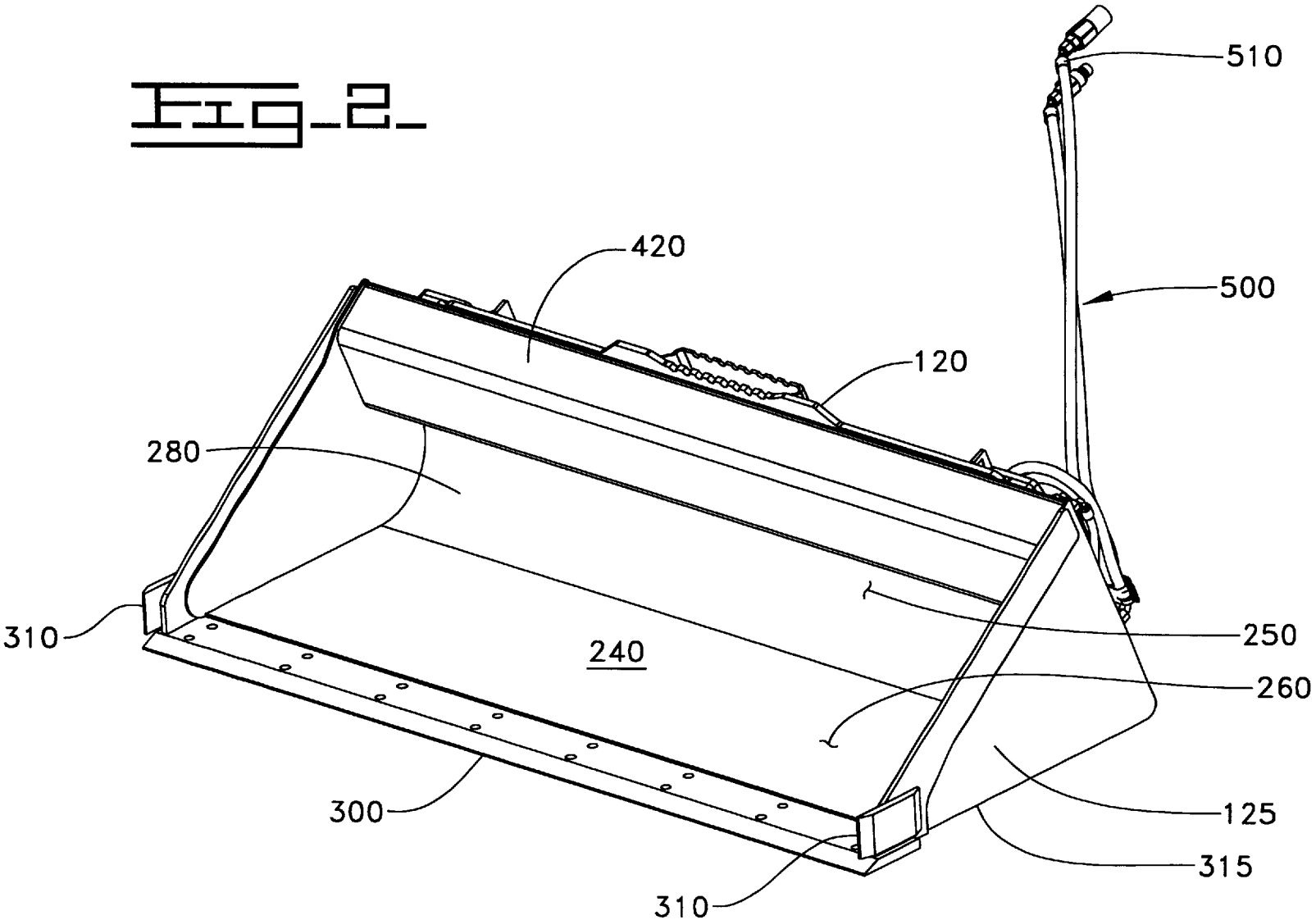
FIG. 2 is a perspective view of the present invention taken from the front showing detail of a bucket and an interface member.
Figure 3:
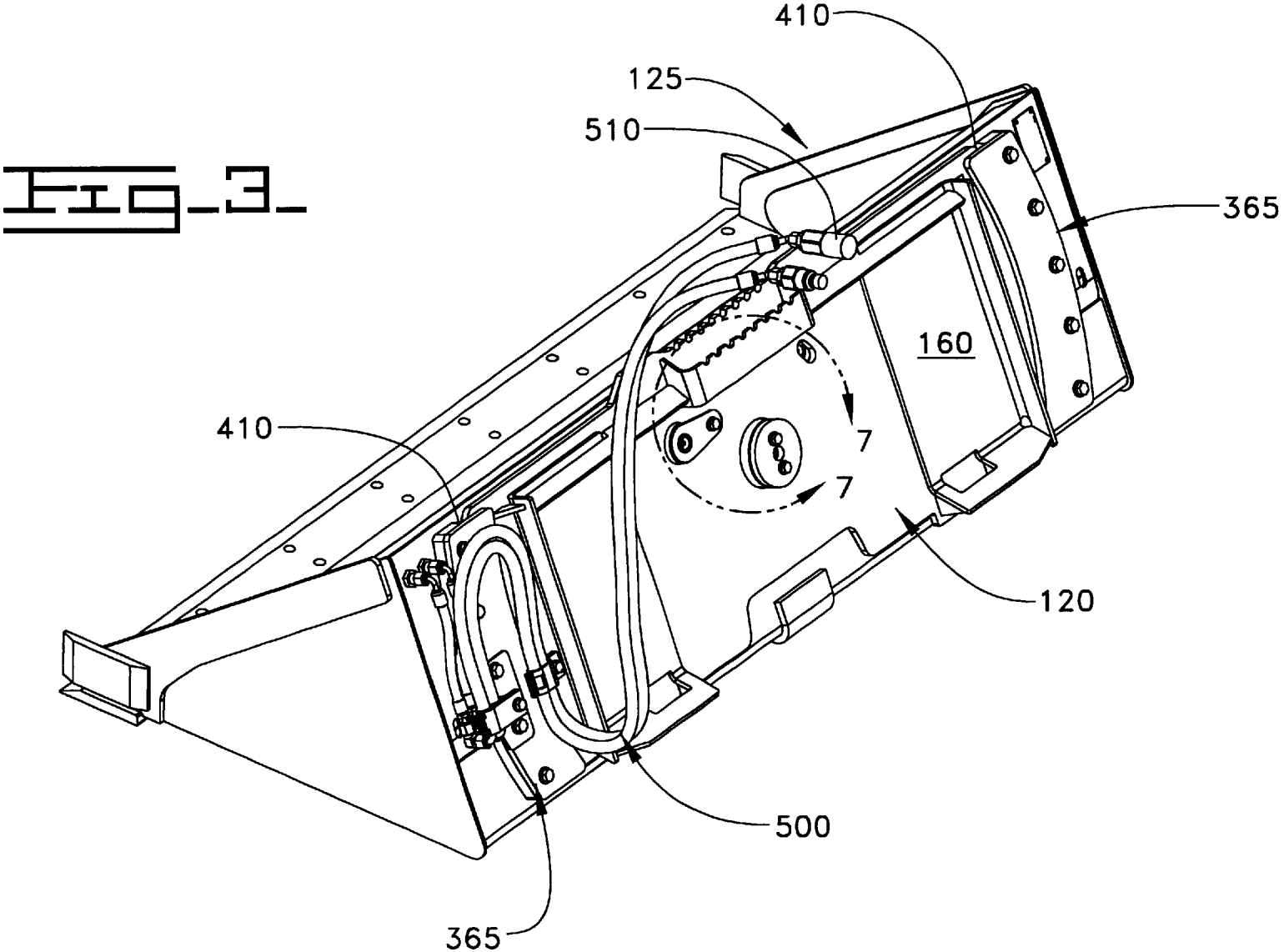
FIG. 3 is a perspective view of the present invention taken from the rear showing detail of the bucket and interface member.
Figure 4A:
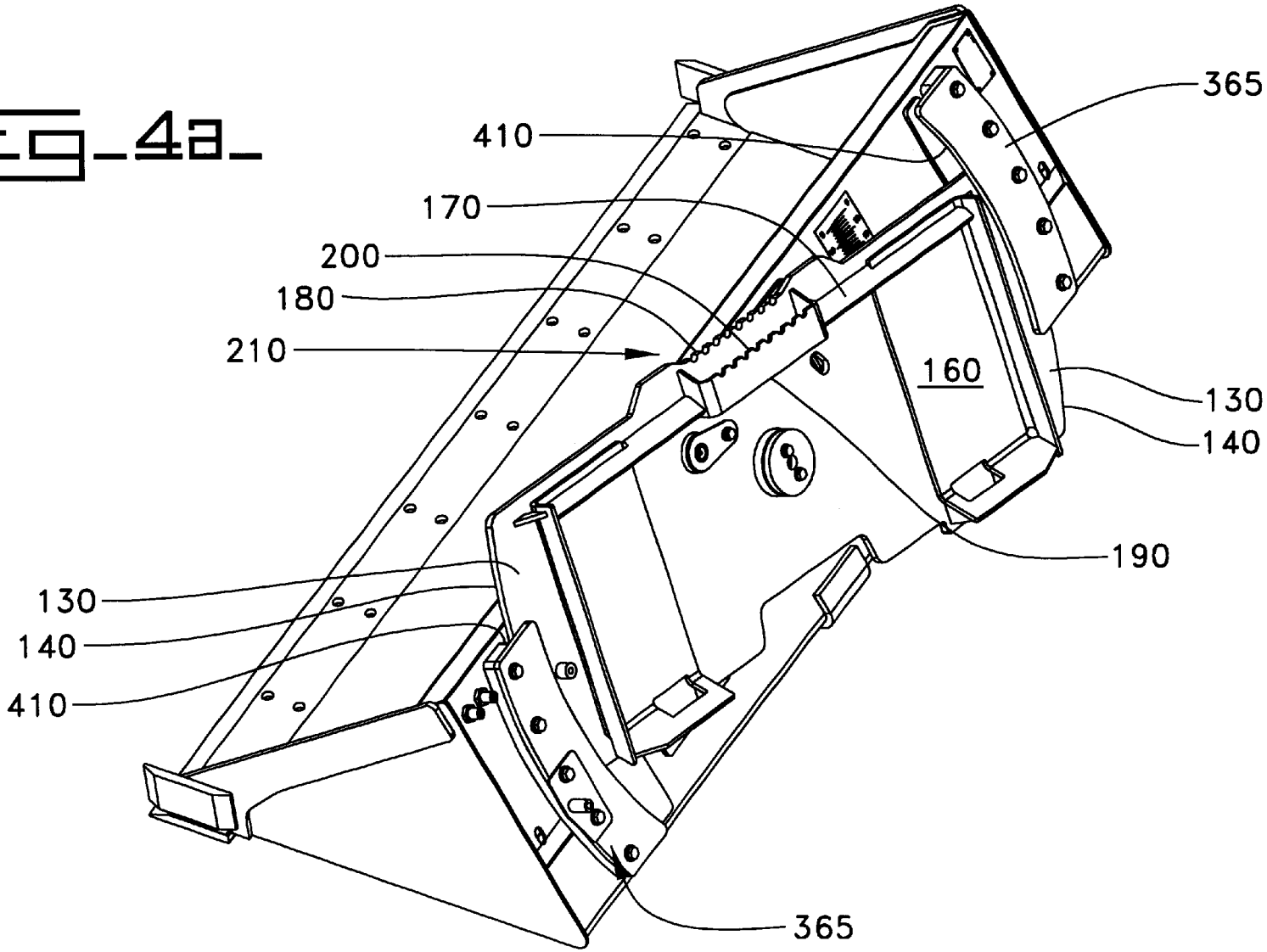
FIG. 4*a* is a perspective view of the present invention taken from the rear showing a first position of rotation for the bucket.
Figure 4B:
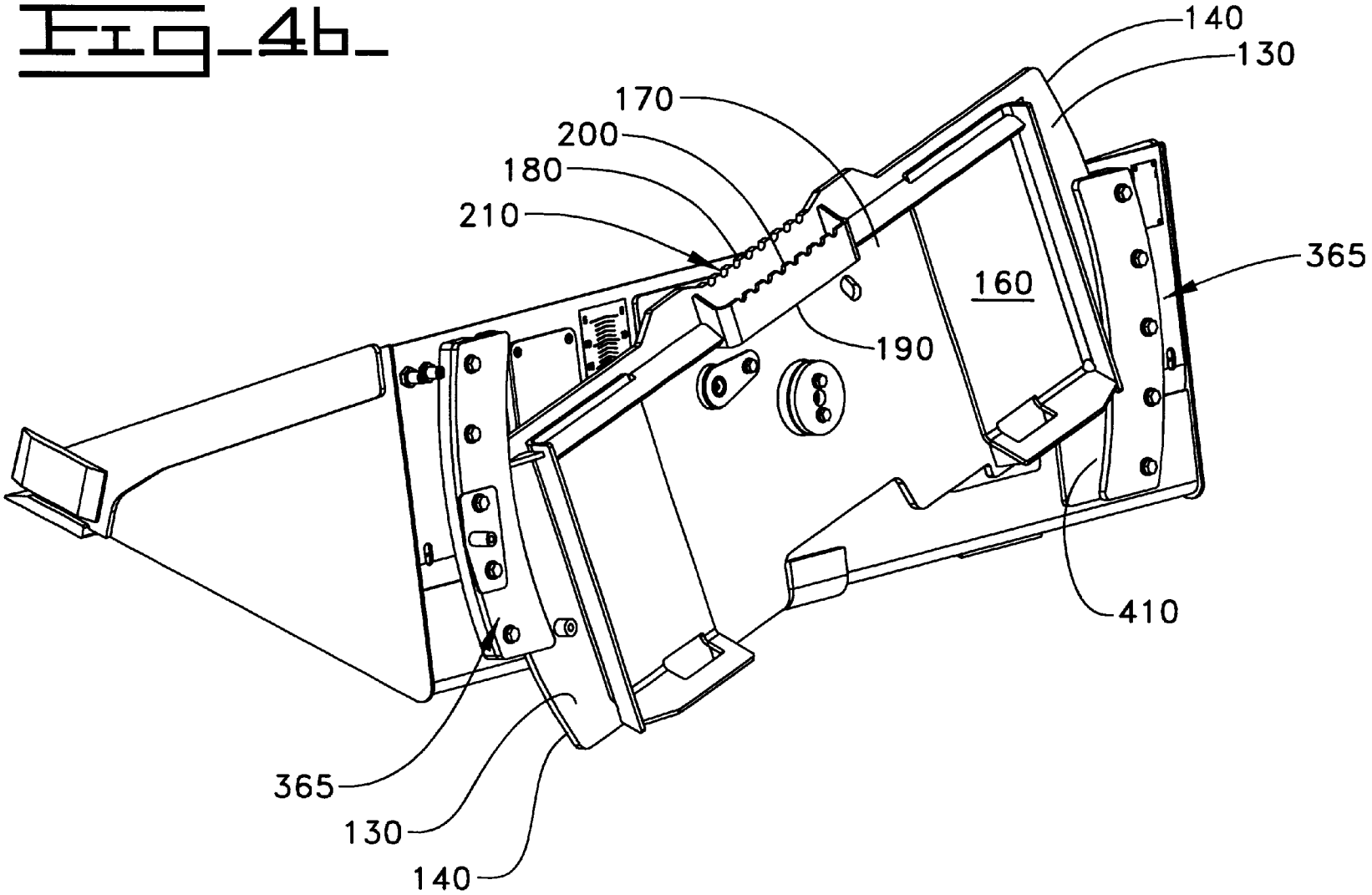
FIG. 4*b* is a perspective view of the present invention taken from the rear showing a second position of rotation for the bucket.
Figure 5:
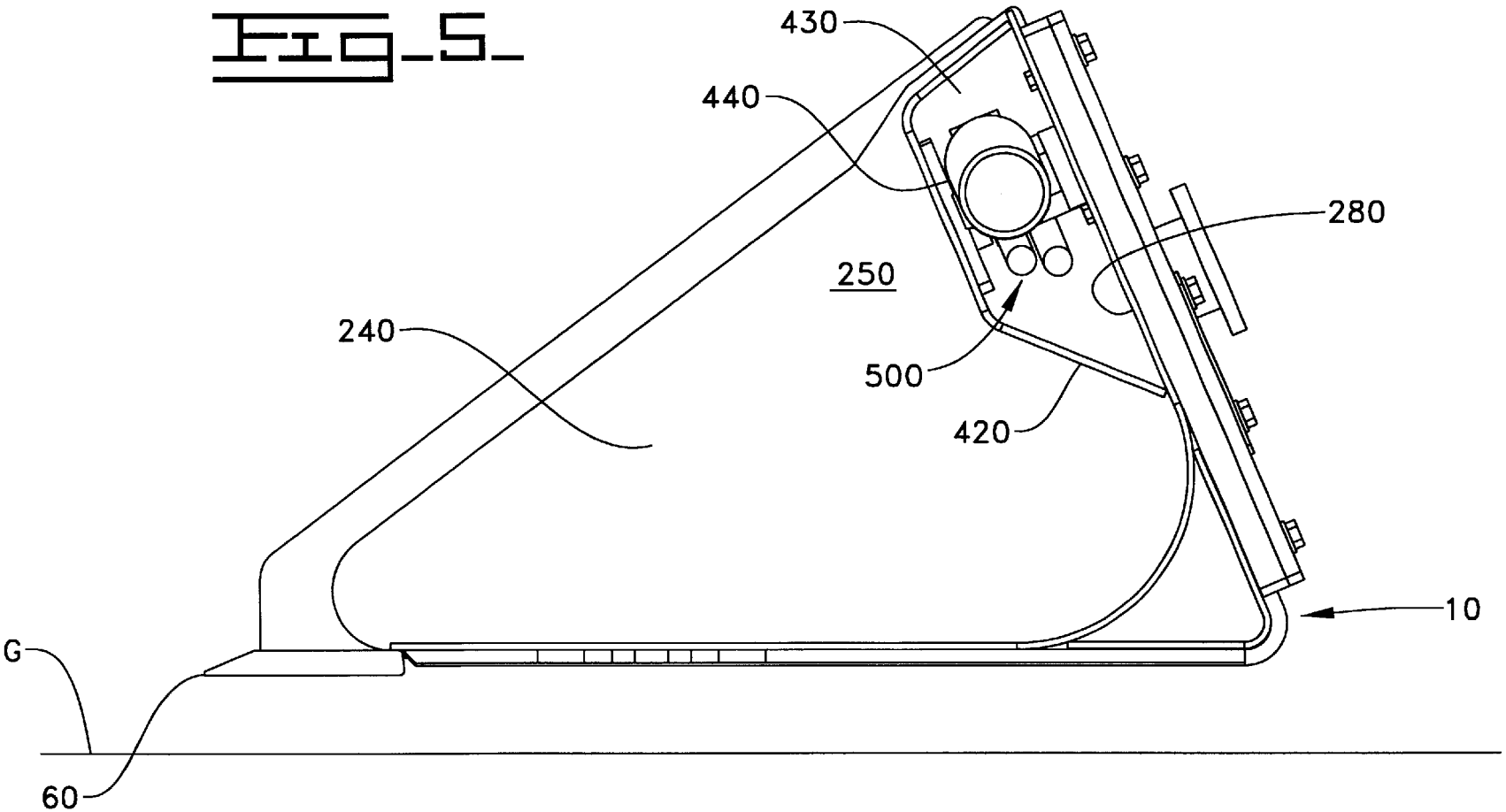
FIG. 5 is a cross-sectional side view of the present invention detailing a hydraulic cylinder located within a substantially isolated chamber within the bucket.
Figure 6:
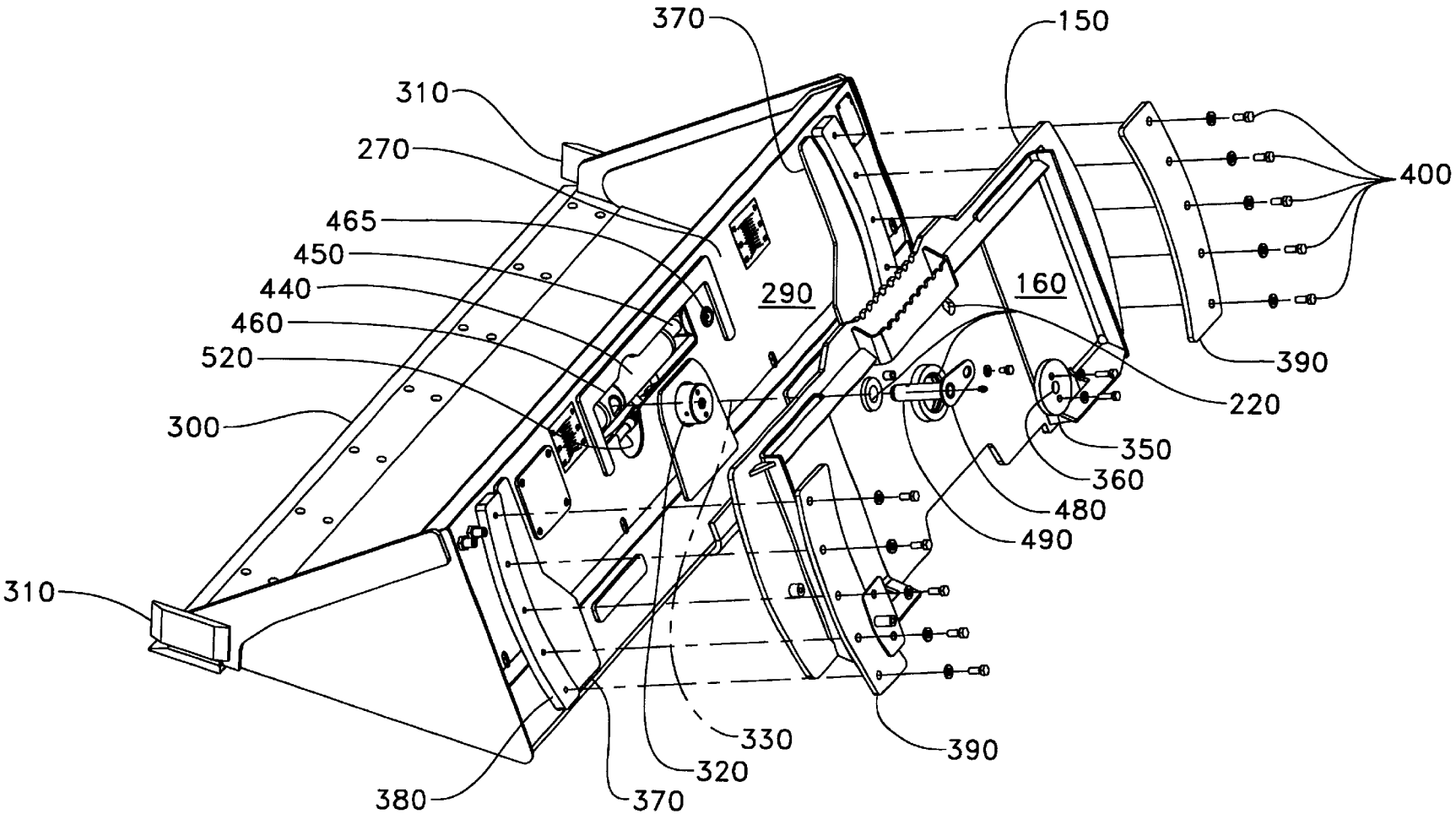
FIG. 6 is an exploded view of the present invention.
Figure 7:
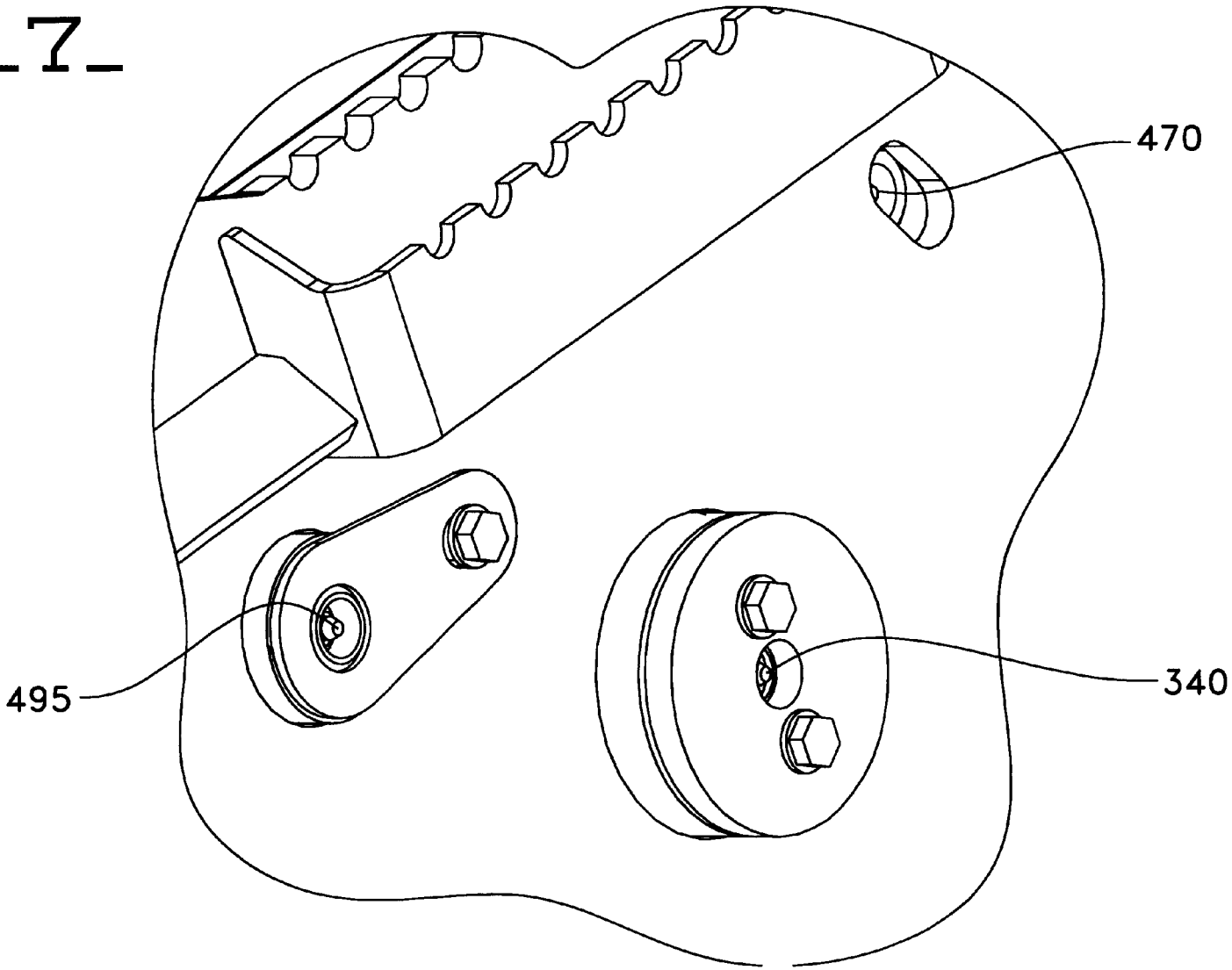
FIG. 7 is a detailed view taken along 7—7 in FIG. 3.

Referring more specifically to FIGS. 2 & 6, the bucket 125 is shown with a front loading portion 240 that has upper and lower regions 250,260, a rear connecting portion 270 with a front surface 280 adjacent the front loading portion 240 and a rear surface 290, a front cutting edge 300 that extends from a bottom surface 315 of the bucket 125, and a side cutting edge 310. A hub portion 320 extends from the rear surface 290 of the rear connecting portion 270 of the bucket 125 and has a longitudinal axis 330 therethrough. A grease zerk 340, seen in FIG. 7, is located at a central region of the hub portion 320 so that lubrication may be provided to the hub portion 320 from an external fluid source in a well known manner. The hub portion 320 extends through one of the plurality of openings 220 in the interface member 120 so that a portion thereof extends past the rear surface 160 of the interface member 120. It should be understood that the longitudinal axis 330 of the hub portion 320 also extends through the one of the plurality of openings 220 in the interface member 120. A cover plate 350 is bolted to the hub portion 320 to rotatably mount the bucket 125 with the interface member 120. The cover plate 350 has a central opening 360 defined therethrough that is coaxially aligned with the grease zerk 340 to provide access from the rear surface 160 of the interface member 120. A pair of spaced guide members 365, seen best in FIGS. 3–4*b* & 6, are connected to the rear surface 290 of the rear connecting portion 270 of the bucket 125 and each include a first curved plate 370, a shim plate 380, and second curved plate 390. The first curved plate 370 is connected in any suitable manner to the rear surface 290. The shim plate 380 is adjacent the first curved plate 370 and connected in any suitable manner to the rear surface 290. It should be understood that the first curved plate 370 and the shim plate 380 are shown welded to the rear surface 290 but any type of connecting method may be used, such as bolts or the like. The second curved plate 390 is connected to the shim plate 380 via a plurality of bolts 400 to define a curved, spaced opening 410 between the first and second curved plates 370,390, as seen best in FIGS. 3–4*b*, through which the curved outer peripheries 140 of the side portions 130 of the interface member 120 extend. A torque tube 420, seen in FIGS. 2 & 5, extends from the front surface 280 of the rear connecting portion 270 and terminates within the upper region 250 of the front loading portion 240 across the entire width of the bucket 125. A substantially enclosed chamber 430, seen only in FIG. 5, is defined within the torque tube 420.

A hydraulic cylinder 440, seen in FIGS. 5–6, is located within the chamber 430. The hydraulic cylinder 440 is movable between fully extended and retracted positions and includes a nominal position therebetween wherein the bottom surface 315 of the bucket 125 and the hydraulic cylinder 440 are parallel with respect to a surface of the ground G. Referring more closely to FIGS. 6, the hydraulic cylinder 440 includes rod and head end portions 450,460. Referring now to FIGS. 6–7, the rod end 450 is connected by a conventional pin 465 to the bucket 125 that includes a grease zerk 470 thereon which is accessible via one of the plurality of openings 220 through the rear surface 160 of the interface member 120 when the hydraulic cylinder 440 is in the nominal position. The head end 460 is connected by a conventional pivotal pin joint 480 to the interface member 120 and includes a pin 490 with a grease zerk 495 thereon which is accessible via one of the plurality of openings 220 through the rear surface 160 of the interface member 120. Referring to FIGS. 1–3 & 6, a plurality of hydraulic lines 500 each include a first end portion 510 connected to the hydraulic system (not shown) of the work machine 10 and a second end portion 520 connected to the hydraulic cylinder 440 for actuating the hydraulic cylinder 440 between the fully extended and retracted positions. A portion of the hydraulic lines 500 are located within the chamber 430, as seen best in FIGS. 5–6.

INDUSTRIAL APPLICABILITY

The tiltable bucket assembly 20 is designed so that the bucket 125 may be rotated +/−15 degrees (clockwise or counter-clockwise) about the longitudinal axis 330 extending through the hub portion 320 and the interface member 120. In order to achieve the rotational movement of the bucket 125, the hydraulic cylinder 440 is actuated from the nominal position by pressurized fluid within the hydraulic lines 500 acting upon the rod end portion 450. When the rod end portion 450 is extended or retracted, a force acts on the structure of the bucket 125. This force produces the clockwise or counter-clockwise rotation, as seen in FIGS. 4*a*–4*b*, due to the connection of the rod and head end portions 450,460 of the hydraulic cylinder 440 to the bucket 125 and interface member 120, respectively, and the angular position of the hydraulic cylinder 440 within the chamber 430. As the bucket 125 rotates, the spaced openings 410 within the guide members 365 are free to move about the outer peripheries 140 of the interface member 120 to guide and support the bucket 125 during rotation.

The ability to utilize only the structure of the tiltable bucket assembly 20 to achieve the rotational movement of the bucket 125 eliminates the need for additional components that greatly increase the distance from anywhere on the work machine 10 to 100 mm behind the front cutting edge 300 of the bucket 120 (break out force). The tiltable bucket assembly 20 has a break out force 1–2% less than the break out force of a conventional non-tiltable bucket. The ability to reduce the break out force loss on the tiltable bucket assembly 20 promotes increased stability and performance over other rotatable bucket designs. Locating the hydraulic cylinder 440 and a portion of the hydraulic lines 500 within the chamber 430 assists in creating the more compact design. Further, the location of the hydraulic cylinder 440 and a portion of the hydraulic lines 500 within the chamber 430 protects the respective components from dirt and debris. Additionally, the plurality of openings 220 through the interface member 120 allow for increased accessibility to the grease zerks 340,470,495 so that the application of lubrication is simple and easy.

Other aspects, objects and advantages of this invention can be obtained from a study of the drawings, disclosure and the appended claims.

What is claimed is:

1. A tiltable bucket assembly, comprising:

a bucket having a front loading portion, a rear connecting portion with a front surface adjacent the front loading portion and a rear surface opposite therefrom, and a pair of spaced guide members connected to the rear surface of the rear connecting portion, the bucket defining a substantially enclosed chamber extending from the front surface of the rear connecting portion and terminating within the front loading portion;

an interface member rotatably mounted with respect to the bucket, the interface member having opposed side portions supported within the guide members; and an actuator located within the chamber and having a first end portion connected to the bucket and a second end portion connected to the interface member, the actuator being adapted to provide rotational movement of the bucket about the interface member.

2. The tiltable bucket assembly of claim 1, wherein the front loading portion has upper and lower regions and the chamber is located within the upper region.

3. The tiltable bucket assembly of claim 1, wherein the connection between the bucket and the interface member occurs at a hub portion extending from the rear connecting portion of the bucket, the hub portion having a longitudinal axis extending therethrough with the bucket being rotated about the longitudinal axis of the hub portion.

4. The tiltable bucket assembly of claim 1, wherein the actuator is disposed parallel within the chamber with respect to a surface of the ground.

5. The tiltable bucket assembly of claim 1, wherein each of the pair of guide members include a pair of curved plates and a shim plate separating the pair of curved plates to define a curved, spaced opening therebetween and the opposed side portions of the interface member each include a curved outer periphery extending within a respective spaced opening defined by the curved plates.

6. The tiltable bucket assembly of claim 1, wherein the actuator is a hydraulic cylinder.

7. The tiltable bucket assembly of claim 6, including a plurality of hydraulic lines connected to the hydraulic cylinder, a portion of the hydraulic lines being within the chamber.

8. The tiltable bucket assembly of claim 1, wherein the interface member has an upper portion with a serrated area.

9. The tiltable bucket assembly of claim 8, including a step member connected at the upper portion of the interface member, the step member has a serrated area spaced a predetermined distance from the serrated area of the interface member to define an operator step.

10. A tiltable bucket assembly, comprising:

a bucket having a front loading portion with upper and lower regions, a rear connecting portion with a front surface adjacent the front loading portion and a rear surface opposite therefrom, a pair of spaced guide members connected to the rear surface of the rear connecting portion with each of the pair of guide members having a pair of curved plates and a shim plate separating the pair of curved plates to define a spaced opening therebetween, and a hub portion extending from the rear surface of the rear connecting portion with a longitudinal axis, the bucket defining a substantially enclosed chamber extending from the front surface of the rear connecting portion and terminating within the upper region of the front loading portion;

an interface member rotatably mounted with the hub portion of the bucket, the interface member having opposed side portions with curved outer peripheries supported within the spaced openings in the guide members; and a hydraulic cylinder located within the chamber and having a first end portion connected to the bucket and a second end portion connected to the interface member, the hydraulic cylinder being adapted to provide rotational movement of the bucket about the longitudinal axis.

11. A work machine having a frame supporting a plurality of wheels, comprising:

a connecting member having a first end portion connectable with the frame and a second end portion, the connecting member being adapted for movement in a vertical plane; and a tiltable bucket assembly including an interface member releasably connected at the second end portion of the connecting member and having opposed side portions, a bucket rotatably mounted with respect to the interface member and having a front loading portion, a rear connecting portion with a front surface adjacent the front loading portion and a rear surface opposite therefrom, and a pair of spaced guide members connected to the rear surface of the rear connecting portion for supporting the opposed side portions of the interface member with the bucket defining a substantially enclosed chamber extending from the front surface of the rear connecting portion and terminating within the front loading portion, and an actuator located within the chamber and having a first end portion connected to the bucket and a second end portion connected to the interface member to provide rotational movement of the bucket about the interface member upon actuation thereof.

12. The work machine of claim 11, wherein the connection between the bucket and the interface member occurs at a hub portion extending from the rear connecting portion of the bucket, the hub portion having a longitudinal axis extending therethrough with the bucket being rotated about the longitudinal axis of the hub portion.

13. The work machine of claim 11, wherein each of the pair of guide members include a pair of curved plates and a shim plate separating the pair of curved plates to define a curved, spaced opening therebetween and the opposed side portions of the interface member each include a curved outer periphery extending within a respective spaced opening defined by the curved plates.

14. The work machine of claim 11, including a front cutting edge on the bucket that is spaced a predetermined distance from the frame of the work machine to define a break out force, the break out force being generally 1–2% less than a conventional non-tiltable bucket.

15. The work machine of claim 11, wherein the actuator is a hydraulic cylinder.

16. The work machine of claim 15, including a plurality of hydraulic lines having a first end portion connectable to the work machine and a second end portion connected to the hydraulic cylinder so that a portion of the hydraulic lines are located within the chamber.

17. The work machine of claim 11, wherein the interface member has a rear surface that defines a plurality of openings therethrough and a plurality of grease zerks are accessible via a respective opening through the rear surface of the interface member.

* * * * *

UNITED STATES PATENT AND TRADEMARK OFFICE

CERTIFICATE OF CORRECTION

PATENT NO. : 6,360,459 B1
DATED : March 26, 2002
INVENTOR(S) : Roy V. Brookhart et al.

It is certified that error appears in the above-identified patent and that said Letters Patent is hereby corrected as shown below:

Title page,
Item [73], please change "Caterpillar Inc." to -- Caterpillar S.A.R.L. --

Signed and Sealed this

Fifteenth Day of April, 2003

JAMES E. ROGAN
*Director of the United States Patent and Trademark Office*